US009661422B2

(12) United States Patent
Pinkerton, III et al.

(10) Patent No.: US 9,661,422 B2
(45) Date of Patent: May 23, 2017

(54) ELECTROACOUSITIC LOUDSPEAKER SYSTEM FOR USE IN A PARTIAL ENCLOSURE

(71) Applicant: Brane Audio, LLC, Austin, TX (US)

(72) Inventors: Joseph F. Pinkerton, III, Austin, TX (US); David A. Badger, Lago Vista, TX (US); William Neil Everett, Cedar Park, TX (US); William Martin Lackowski, Austin, TX (US)

(73) Assignee: BRANE AUDIO, LLC, Austin, TX (US)

( * ) Notice: Subject to any disclaimer, the term of this patent is extended or adjusted under 35 U.S.C. 154(b) by 23 days.

(21) Appl. No.: 14/734,195

(22) Filed: Jun. 9, 2015

(65) Prior Publication Data

US 2016/0366521 A1 Dec. 15, 2016

(51) Int. Cl.
*H04R 25/00* (2006.01)
*H04R 19/02* (2006.01)
(Continued)

(52) U.S. Cl.
CPC ..... *H04R 19/02* (2013.01); *H04R 1/025* (2013.01); *H04R 7/045* (2013.01); *H04R 19/013* (2013.01);
(Continued)

(58) Field of Classification Search
CPC ..... H04R 1/24; H04R 1/2811; H04R 3/06; H04R 19/013; H04R 19/02; H04R 31/003;
(Continued)

(56) References Cited

U.S. PATENT DOCUMENTS 3,136,867 A * 6/1964 Brettell ..... H04R 19/02 381/116
3,892,927 A * 7/1975 Lindenberg ..... H04R 19/02 381/116
(Continued)

FOREIGN PATENT DOCUMENTS

DE 4041544 6/1992
DE 19503728 8/1996
(Continued)

*Primary Examiner* — Huyen D Le
(74) *Attorney, Agent, or Firm* — Van Court & Aldridge LLP

(57) ABSTRACT

This disclosure relates to loudspeakers that use one or more stacks of electrically actuated cards that pump air through vents to produce sound waves in response to an acoustic signal. Each stack can include several electrostatic actuator cards that are stacked on top of each other and collectively operate to pump air through a vent to produce a sound wave. Each card may include an electrically conductive membrane that is pushed/pulled between two electrically conductive stators. As the membrane is pushed and pulled along a first axis, air is pumped through vents in a direction orthogonal to the first axis. In one embodiment, stacks of cards can be arranged in series to increase sound pressure generated by the loud speaker. In another embodiment, a single stack of cards can be driven with relatively high electric field strength to increase the sound pressure generated by the loud speaker.

12 Claims, 17 Drawing Sheets

(51) Int. Cl.

| | |
|---|---|
| ***H04R 19/08*** | (2006.01) |
| ***H04R 1/02*** | (2006.01) |
| ***H04R 19/01*** | (2006.01) |
| ***H04R 7/04*** | (2006.01) |
| *H04R 1/28* | (2006.01) |

(52) U.S. Cl.
CPC ..... *H04R 19/08* (2013.01); *H04R 1/2819* (2013.01); *H04R 2217/01* (2013.01); *H04R 2400/13* (2013.01)

(58) Field of Classification Search
CPC ..... H04R 2307/023; H04R 2307/025; H04R 2307/027; H04R 1/025; H04R 1/2819; H04R 19/016; H04R 19/08; H04R 2217/03; H04R 2400/13
USPC ..... 381/113, 116, 174, 190, 191, 354
See application file for complete search history.

(56) References Cited

U.S. PATENT DOCUMENTS

| | | | | |
|---|---|---|---|---|
| 3,941,946 | A * | 3/1976 | Kawakami ..... | H04R 19/02 381/116 |
| 8,184,832 | B2 | 5/2012 | Harman | |
| 2007/0189559 | A1 | 8/2007 | Haan et al. | |
| 2007/0274558 | A1 | 11/2007 | Lyon | |
| 2015/0208174 | A1 | 7/2015 | Pinkerton et al. | |
| 2015/0208175 | A1 | 7/2015 | Pinkerton et al. | |

FOREIGN PATENT DOCUMENTS

| | | |
|---|---|---|
| EP | 2775737 | 9/2014 |
| WO | 03/081762 | 10/2003 |

* cited by examiner

ELECTROACOUSITIC LOUDSPEAKER SYSTEM FOR USE IN A PARTIAL ENCLOSURE

TECHNICAL FIELD

This patent specification relates to sound systems, and in particular, to sound systems having electrostatic transducers. More particularly, this specification relates to sound systems that use stacked electrostatic actuator cards.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Conventional audio speakers compress/heat and rarify/cool air (thus creating sound waves) using mechanical motion of a cone-shaped membrane at the same frequency as the audio frequency. Many cone speakers convert less than ten percent of their electrical energy into audio energy. These speakers are typically bulky because enclosures are used to muffle the sound radiating from the backside of the cone (which is out of phase with the front-facing audio waves). Cone speakers also depend on mechanical resonance. A large "woofer" speaker does not efficiently produce high frequency sounds, and a small "tweeter" speaker does not efficiently produce low frequency sounds.

When conventional audio speakers are used in limited space environments such as in speaker bars or televisions, they can suffer from several drawbacks. For example, conventional speakers do not have a thin form factor, generate substantial physical vibration (resulting in wall or floor rattle), and generally require a separate subwoofer to provide low bass frequencies (20-80 Hz). Accordingly, what is needed a loudspeaker that can be used in limited space environments such as sound bar and televisions that supply low bass frequencies without a separate subwoofer, have a thin form factor, are lightweight, and generate very little physical vibration.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Loudspeakers having electrostatic transducers are discussed herein. More particularly, the loudspeakers use a stack of electrostatic actuator cards that are contained within a partial enclosure. One or more stacks of electrostatic actuator cards can be used in limited space environments such as sound bar and televisions that supply low bass frequencies without a separate subwoofer, have a thin form factor, are lightweight, and generate very little physical vibration. For example, in one embodiment, a loudspeaker can include a partial enclosure having at least two openings exposed to an ambient environment, a series stack of electrostatic actuator cards secured within the partial enclosure, and control circuitry coupled to the series stack. The series stack direct in-phase sound waves out at least one of the two openings and the control circuitry can drive the electrostatic actuator cards to generate sound waves in response to an acoustic signal. The series stack can be a series arrangement of two or more stacks of electrostatic actuator cards, where the electrostatic actuator cards of each stack are mounted on top of each other. The series arrangement of the card stacks increases the sound pressure that can be generated by the loudspeaker.

In another embodiment, a loudspeaker is provided. The loudspeaker can include a partial enclosure having an acoustic pathway that extends between first and second openings exposed to an ambient environment, and a series stack of electrostatic actuator cards positioned in the acoustic pathway. The series stack can include several electrostatic actuator cards stacks arranged in series such that any two immediately adjacent card stacks have co-aligned vent members that enable inter-stack flow of air between the two adjacent card stacks when the series stack is generating sound waves to be emitted out of at least one of the first and second openings.

In yet another embodiment, a loudspeaker is provided that can include a partial enclosure having an acoustic pathway that extends between first and second openings exposed to an ambient environment. The loudspeaker can include a single stack of electrostatic actuator cards positioned in the acoustic pathway. The single stack can include a plurality of stators, each having first and second sides that are laminated with a polyester film, and a plurality of membranes, wherein one of the membranes is positioned between two adjacent stators and electrostatically actuated based on an electric field existing between the two adjacent stators. The loudspeaker can include control circuitry operative to control the direction of the electric field existing between each pair of adjacent stators to generate sound waves that are emitted into the acoustic pathway. In some embodiments, a magnitude of the electric field existing between each pair of adjacent stators can be at least 3 volts per micrometer.

Various refinements of the features noted above may be used in relation to various aspects of the present disclosure. Further features may also be incorporated in these various aspects as well. These refinements and additional features may be used individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

A further understanding of the nature and advantages of the embodiments discussed herein may be realized by reference to the remaining portions of the specification and the drawings.

DETAILED DESCRIPTION OF THE DISCLOSURE

Figure 1:
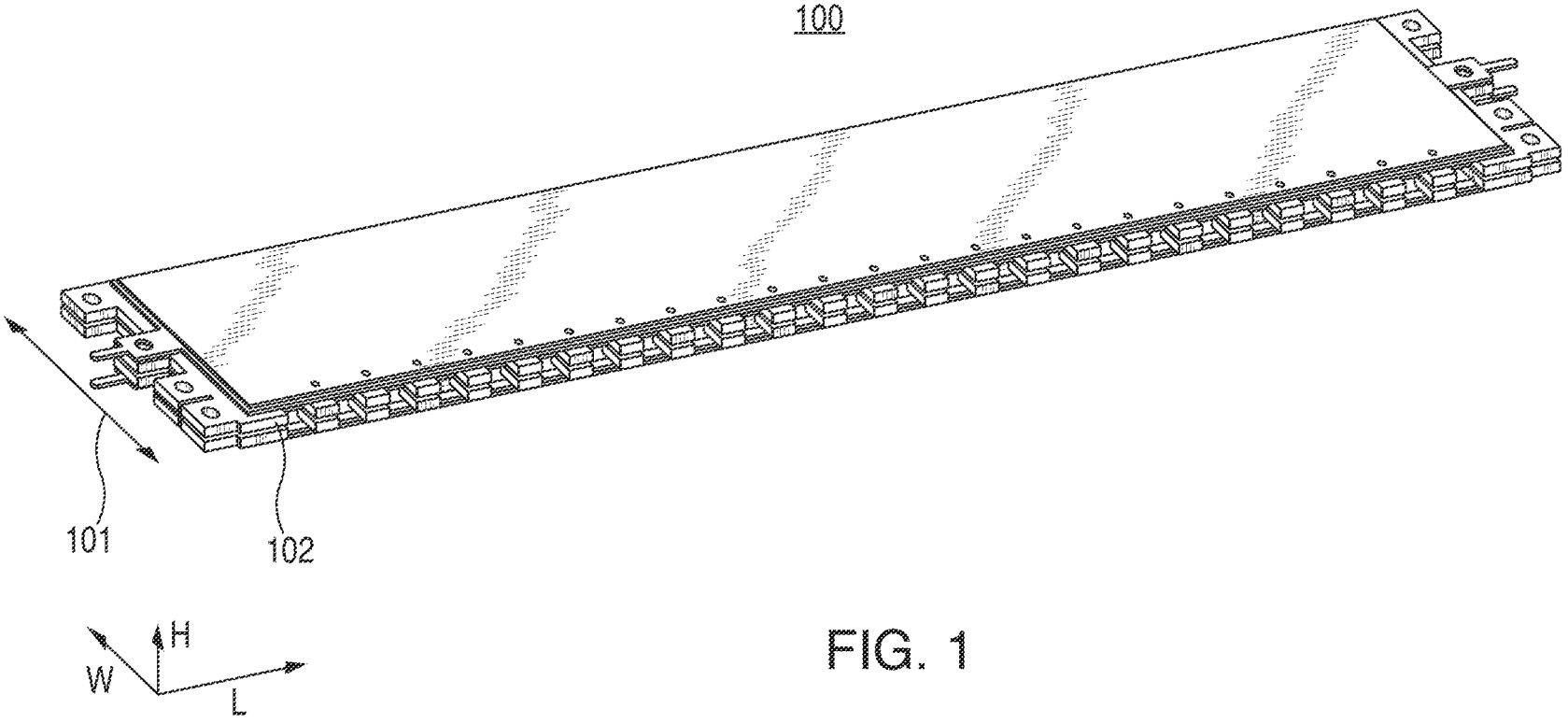
FIG. 1 shows an illustrative perspective view of an electrostatic actuator card with shared stator, according to an embodiment.

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more loudspeaker embodiments are described further herein in the context of being used in a limited space environment, such as a sound bar or television, the scope of the present teachings is not so limited. More generally, loudspeakers are applicable for use in a wide variety of environments such as, for example, portable speakers, boom box speakers, computer speakers, stadium and rock concert speakers, and car speakers.

This disclosure relates to loudspeakers that use one or more stacks of electrically actuated cards that pump air through vents to produce sound waves in response to an acoustic signal. Each stack can include several electrostatic actuator cards that are stacked on top of each other and collectively operate to pump air through a vent to produce a sound wave. Each card may include an electrically conductive membrane that is pushed/pulled between two electrically conductive stators. As the membrane is pushed and pulled along a first axis, air is pumped through vents in a direction orthogonal to the first axis. Each card may span any suitable length and have a fixed width and thickness, where air is pumped into and out of the card. Each card may be able to displace a quantity of air equal to at least 45% of its own volume. As a result, the combined air displacement generated by the stack of cards yields a loudspeaker that is thinner, cheaper, and more efficient than conventional magnet-based speakers and conventional electrostatic speakers.

Two or more stacks of electrostatic actuator cards may be arranged in series to generate additional air displacement or sound pressure to produce sound waves suitable for use in a partial enclosure such as a sound bar or television. For example, in one embodiment, several stacks of cards can placed in series within a partial enclosure having openings for emitting in-phase and delayed out-of-phase sounds produced by the series stack of cards. The enclosure can include multiple series stacks of cards, as desired. For example, in one embodiment, a first series stack of cards may be provided for producing sounds within a first frequency range and a second series stack of cards may be provided for producing sounds within a second frequency range. Additional details on these embodiments are described more fully below.

FIG. 1 shows an illustrative perspective view of electrostatic actuator card 100 with shared stator, according to an embodiment. As shown, card 100 spans length, L, has width, W, and height, H. The length, L, may be any suitable length. For example, in some embodiments, the length may be greater than the width, W. The width, W, may be dimensioned to accommodate spacing requirements of an enclosure or to meet specific performance criteria. For example, the width may be dimensioned for generating sound waves according to a desired frequency. The height of card 100 may be made as thin as possible so that as many cards can be stacked on top of each other within a defined space. For example, in some embodiments, each card may have a thickness of about 1 mm, thereby enabling approximately 25 cards to be stacked in a one inch space.

When card 100 is pumping air, the air may pass in and out of card 100 in a direction perpendicular to the length of the card. This direction is shown by arrow 101. Thus, during operation, air is pumped in and out along the length of card 100. As shown in FIG. 1, air may be pumped in/out of first face 102. Although air is only shown being pumped in and out of first face 102, it should be appreciated that card 100 can be rotated 180 degrees so that air is pumped in and out of a second face, which opposite of first face 102. In addition, as will be explained in more detail below, when another card 100 is rotated and placed on top of card 100, air may be pumped in and out of both faces of the card.

Figure 2:
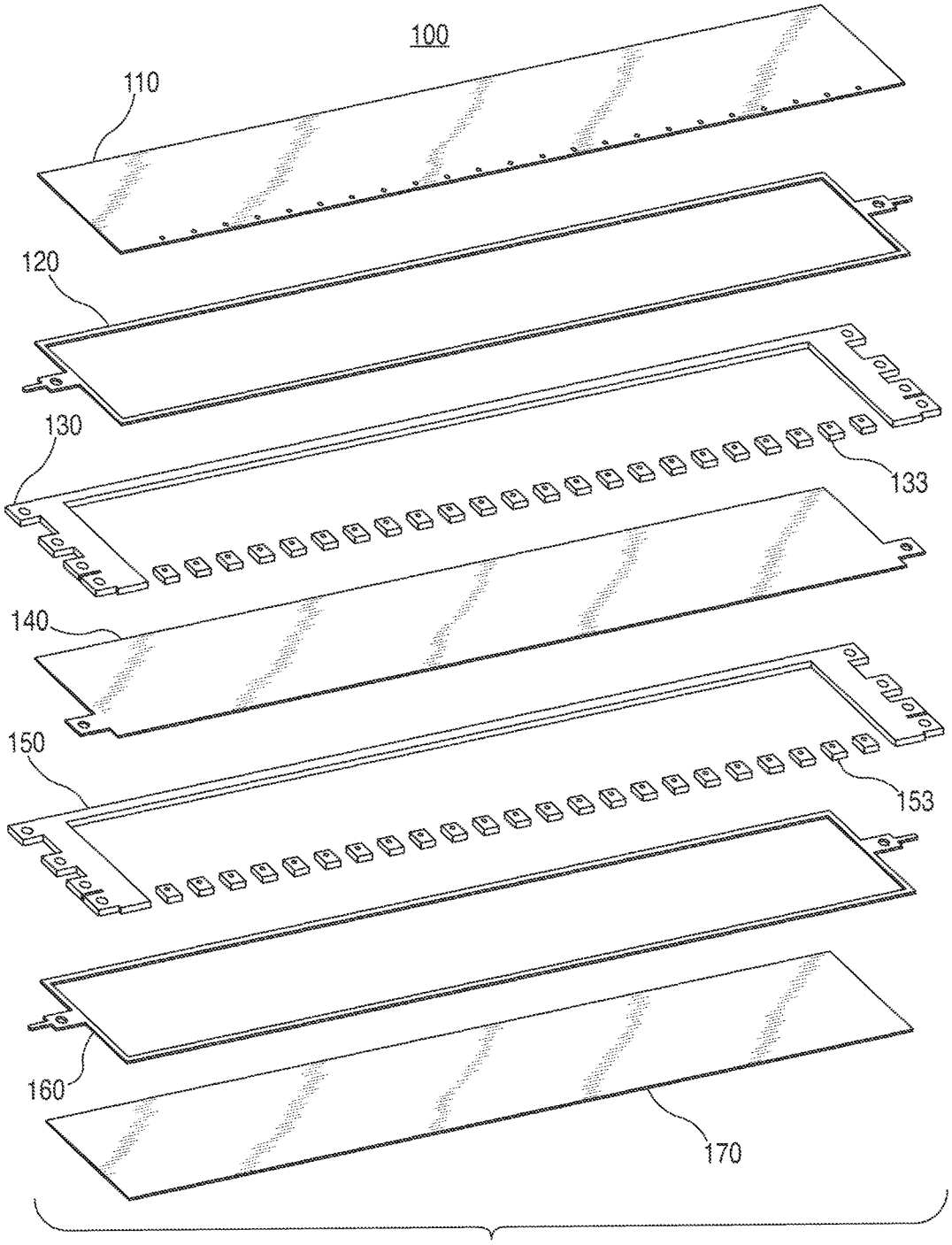
FIG. 2 shows an illustrative exploded view of the card of FIG. 1, according to an embodiment.

FIG. 2 shows an illustrative exploded view of card 100, according to an embodiment. Card 100 can include an electrically conductive membrane 110, first metal frame 120, first non-conductive vent member 130 (with its vent fingers 133), solid metal stator 140, second non-conductive vent member 150 (with its vent fingers 153, and second metal frame 160, and second electrically conductive membrane 170. These components can be joined together with epoxy, double-sided tape, sheet adhesive or by using any other suitable bonding process. After membrane 110 is bonded to frame 120, its entire outside edge (peripheral edge) is supported by frame 120. During operation, membrane 110 can be pushed and pulled up and down to pump air in and out of a cavity (not shown) existing within the confines of membrane 110, metal frame 120, vent member 130, and stator 140. The air may enter and exit the cavity via gaps existing between vent fingers 133. Thus, the air may enter and exit the cavity in a direction orthogonal to the up and down movement of membrane 110. Similarly, during operation, membrane 170 may be pushed and pulled up and down to pump air in out of a cavity existing with the confines of membrane 170, metal frame 160, vent member 150, and stator 140. The air may enter and exit the cavity via gaps existing between vent fingers 153. This air, too, may enter and exit the cavity in a direction orthogonal to the up and down movement of membrane 170.

It should be understood that the components of card 100 may be different than that what is described herein. For example, card 100 may not include membrane 170. In another embodiment, card 100 may include membrane 110, frame 120, vent member 130, and stator 140, but not vent member 150, frame 160, and membrane 170.

Membranes 110 and 170 may be constructed from a polyester film having a vapor deposited metal existing thereon. Membranes 110 and 170 may be manufactured to have a thickness ranging between 1-12 microns, and in one embodiment, may be about 6 microns thick. Stator 140 may be manufactured from stainless steel or other suitable conductive material, and may be manufactured to have a thickness ranging between 50-100 microns. Metal frames 120 and 160 may be constructed from a metal material such as stainless steel, and may have a thickness ranging between 50-300 microns. Vent members 130 and 140 may be constructed from a non-conducive material such as plastic or fiberglass, and may have a thickness ranging between 300-600 microns.

In some embodiments, metal frames 120 and 160 may be laminated on both of their respective sides with an insulating film. In addition, stator 140 may also be laminated on both sides with an insulating film. The insulating film can be a combination PET/Mylar-adhesive. Other insulating films may be used so long as they prevent electrical breakdown/arcing within the air gaps located between the frames and stator.

Figure 3:
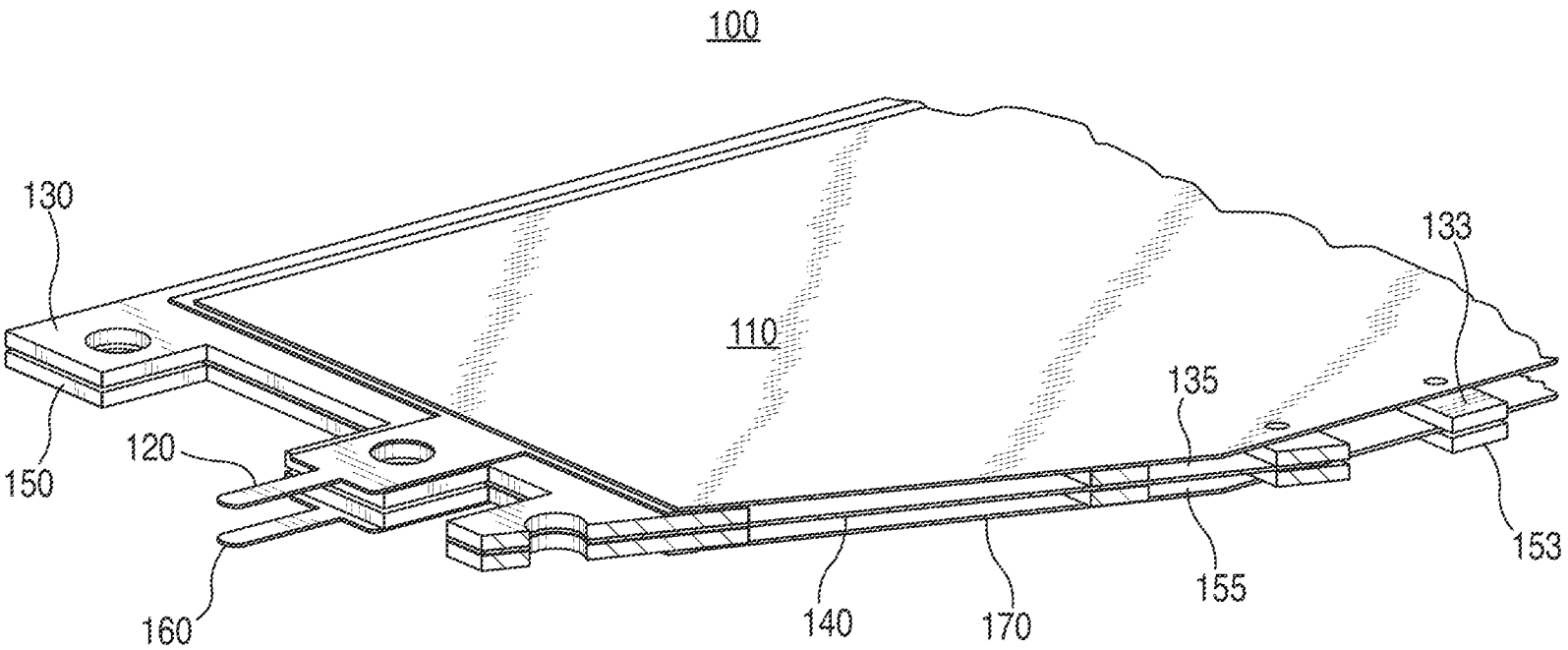
FIG. 3 shows a partial cross-sectional view of the card of FIG. 1, according to an embodiment.

It should be appreciated that stator 140 is shared between membranes 110 and 170. This is more clearly illustrated in FIG. 3, which shows a partial cross-sectional view of card 100, according to an embodiment. FIG. 3 shows membrane 110 secured to the top of first metal frame 120, which sits on top of vent member 130, which sits on top of stator 140. FIG. 3 also shows that vent member 150 is secured to the bottom of stator 140, that metal frame 160 is secured to the bottom of vent member 150, and that membrane 170 is secured to the bottom of metal frame 160. Gaps 135 and 155 exist between vent fingers 133 and 153, respectively. Gaps 135 provide air ingress and egress channels for pumping air in to and out of the cavity associated with membrane 110, frame 120, vent member 130, and stator 140. Similarly, gaps 155 provide air ingress and egress channels for pumping air in to and out of the cavity associated with stator 140, vent member 150, frame 160, and membrane 170.

What is not shown in FIGS. 1-3 are stators mounted above membrane 110 and below membrane 170. Such stators may be needed to generate the electric field necessary to push and pull the membranes up and down to pump air. The mounting of these stators may be realized in several different embodiments. In one embodiment, another card such as card 100 can be mounted above membrane 110, and yet another card can be mounted below membrane 170. The orientation of the additional cards may be the same as that shown in FIGS. 1-3, or the orientation may be rotated 180 degrees with respect to card 100 shown in FIGS. 1-3. A stack of cards all having the same orientation may result in a stack where the air ingress and egress gaps all exist on the same face of the stack. A stack of cards having alternating orientations may result in a stack where the air ingress and egress gaps exist on the opposite faces of the stack. Alternating the orientation of the cards as described below enables air to be pulled in from one side of the stack and pushed out the other side of the stack, for any given cycle.

Figure 4:
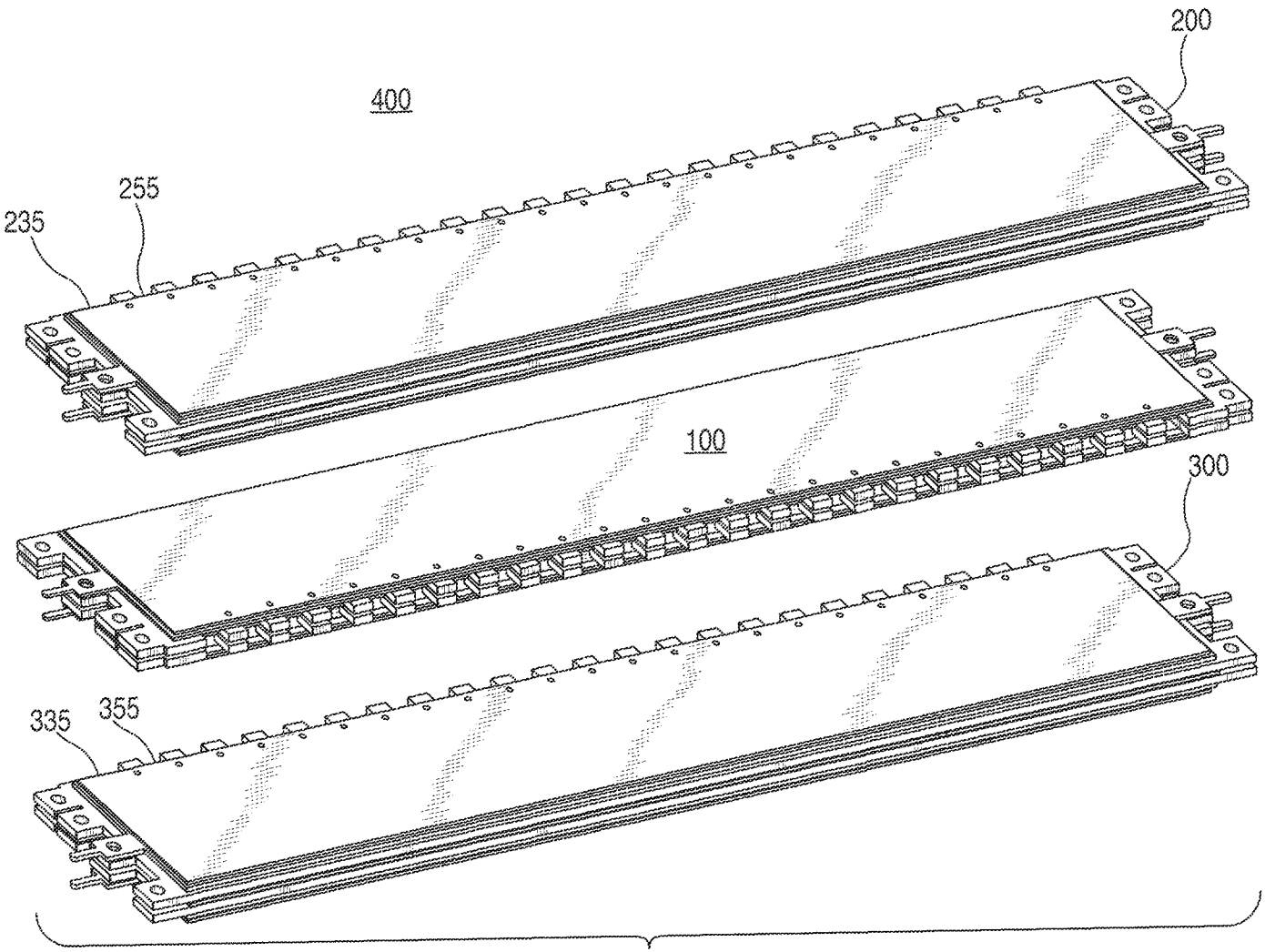
FIG. 4 shows an illustrative partially exploded view of a card stack that has alternating card orientations according to an embodiment.

FIG. 4 shows an illustrative partially exploded view of stack 400 that has alternating card orientations according to an embodiment. In particular, stack 400 shows card 100 flanked by card 200 and card 300. Cards 200 and 300 may the same as card 100, but rotated 180 degrees such that their respective gaps are opposite of the gaps of card 100. As shown, card 100 shows air gaps 135 and 155 existing on first side 401, and cards 200 and 300 show respective air gaps 235 and 255, and 335 and 355 existing on second side 402. Note that air gaps 135, 235, and 335 exist on the top of their respective cards and air gaps 155, 255, and 355 exist on the bottom of their respective cards. Thus, air gaps 135, 235, and 335 may be positioned above respective air gaps 155, 255, and 355. With this arrangement, membrane 110 is positioned between stator 140 of card 100 and the stator of card 200, and membrane 170 is positioned between stator 140 of card 100 and the stator of card 300. In stack 400, when membrane 110 is pushed up, air may be exhausted out of air gaps 255 and air may be inlet through air gaps 135. When membrane 110 is pushed up, membrane 170 is pulled down, resulting in air being inlet through air gaps 155 and air being egressed through air gaps 335. When membrane 110 is pulled down, air may be exhausted out of air gaps 135 and air may be inlet through air gaps 255. When membrane 110 is pulled down, membrane 170 is pushed up, resulting in air being inlet through air gaps 335 and air being exhausted through air gaps 155.

Figure 5:
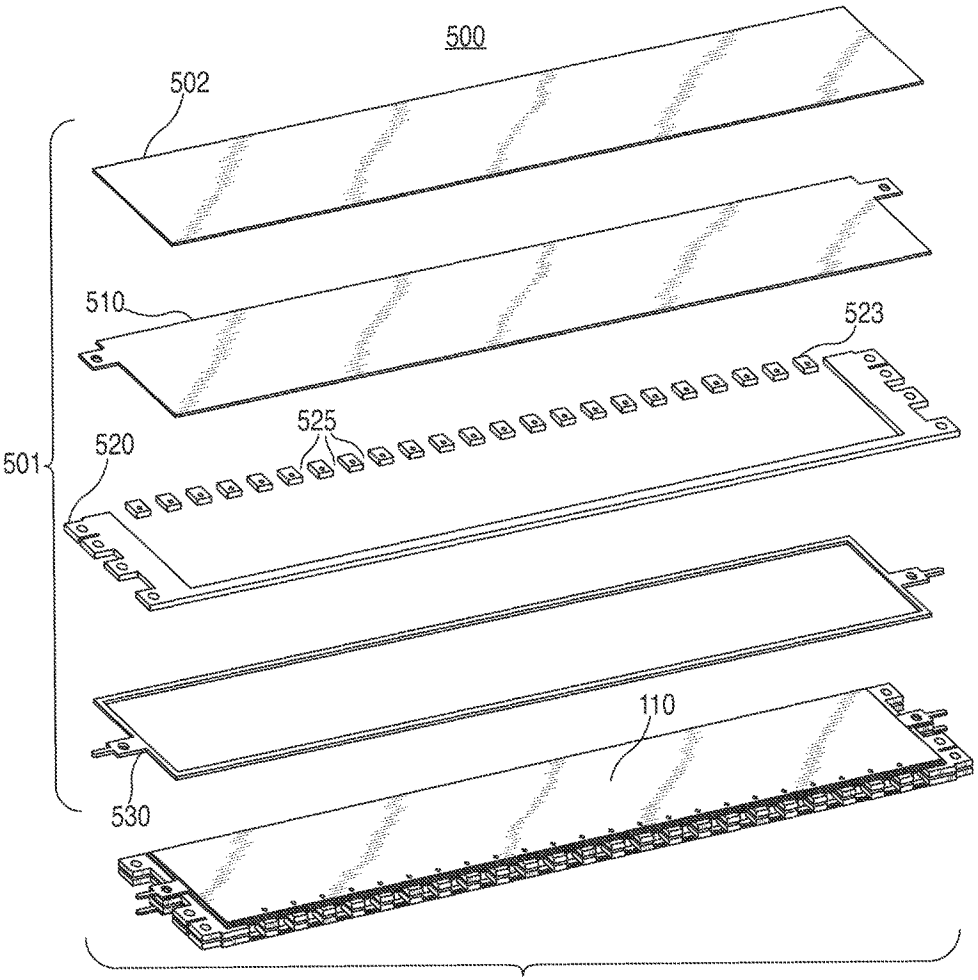
FIG. 5 shows an illustrative partially exploded view of stack including the card of FIG. 1 and another card, according to an embodiment.

FIG. 5 shows an illustrative partially exploded view of stack 500 including card 100 and card 501 according to an embodiment. Card 501 may be similar to card 100, but does not have a shared stator. That is, card 501 can include cap member 502, stator 510, vent member 520 with vent fingers 523 (where air gaps 525 exist between fingers 523), and metal frame member 530. Vent fingers 523 may be arranged opposite of vent fingers 123 and 153. When cards 100 and 501 are secured to each other, metal frame member 530 may be secured to the top of membrane 110, vent member 520 is secured to the top of frame member 530, stator 510 is secured to the top of vent member 520, and cap member 502 may be secured on top of stator 510. Cap member 502 may define an end point of stack 500. If desired, another card 501 may be secured to the bottom of card 100 to define a bottom end of stack 500. During operation of stack 500, when membrane 110 is pushed up, air may be exhausted out of air gaps 525 and air may be inlet through air gaps 135. When membrane 110 is pulled down, air may be exhausted out of air gaps 135 and air may be inlet through air gaps 525.

Figure 6A:
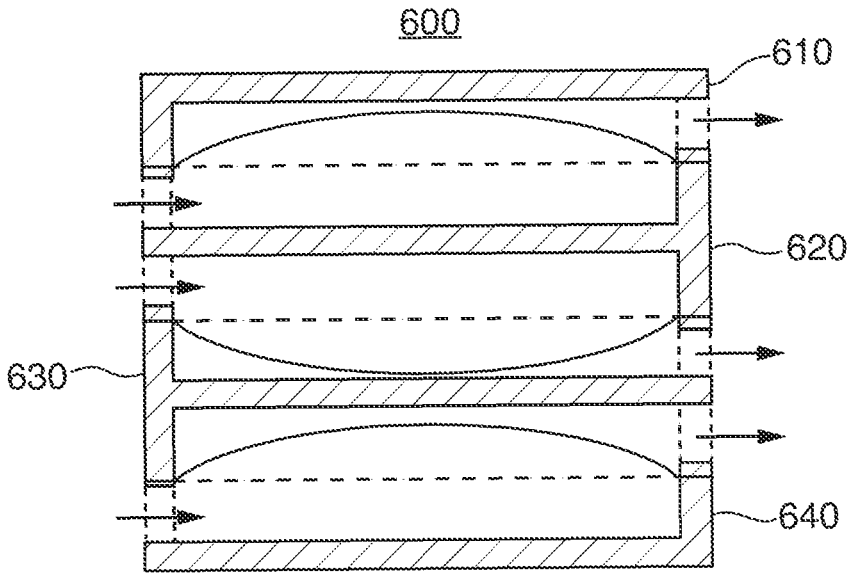
FIGS. 6A and 6B show illustrative cross-sectional views of a single stack of cards, according to embodiment.
Figure 6B:
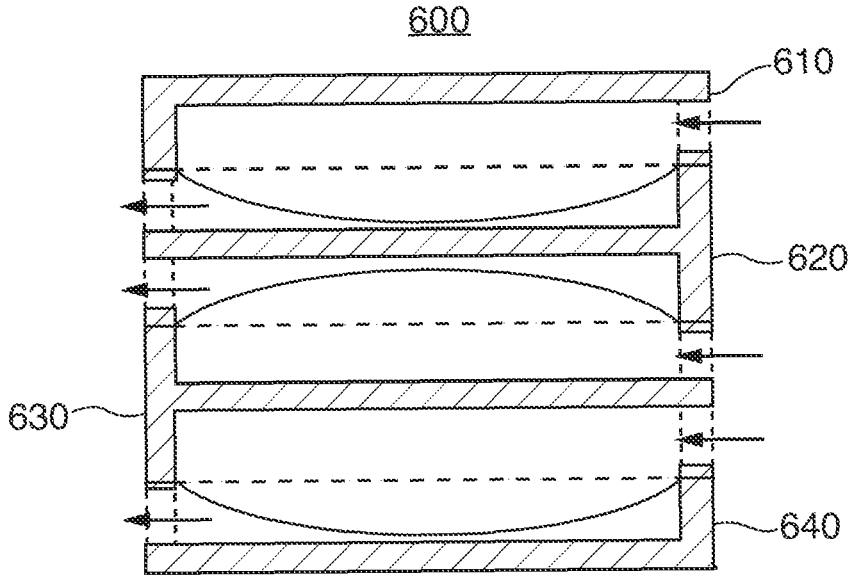

FIGS. 6A and 6B show illustrative cross-sectional views of a single stack of cards 600 according to an embodiment. Single stack 600 can include top card 610, intermediate cards 620 and 640, and bottom card 640. Top and bottom cards 610 and 640 may resemble card 501 in that they do not have a shared stator, and intermediate cards 620 and 630 may resemble card 100 in that they each have a shared stator. Stack 600 has four stators and three membranes, though it should be understood that as additional cards are stacked on top of each other, the number of stators and membranes would grow. FIG. 6A shows a first half cycle (of an audio signal) that illustrates the position of the membranes and air ingress/egress during that cycle and FIG. 6B shows a second half cycle (of that audio signal) that illustrates the position of the membranes and air ingress/egress during that cycle. The arrows show the ingress/egress direction of air being pumped through the gaps for a given cycle. Note that during any half cycle, approximately half of the membranes are pushed in one direction and the other half are pulled in the opposite direction. As a result, these mechanical motions effectively cancel out any vibration within the card stack.

Single stack 600 shows air being pumped in/out of both sides of the stack. Such an arrangement may be suitable for use in a partial enclosure that has openings open to an ambient environment. The partial enclosure may be a stand-alone enclosure designed to house one or more stacks of cards according to various embodiments. The enclosure can be integrated within a product such as a television or it can exist independently such as in the form of a sound bar.

Figure 7A:
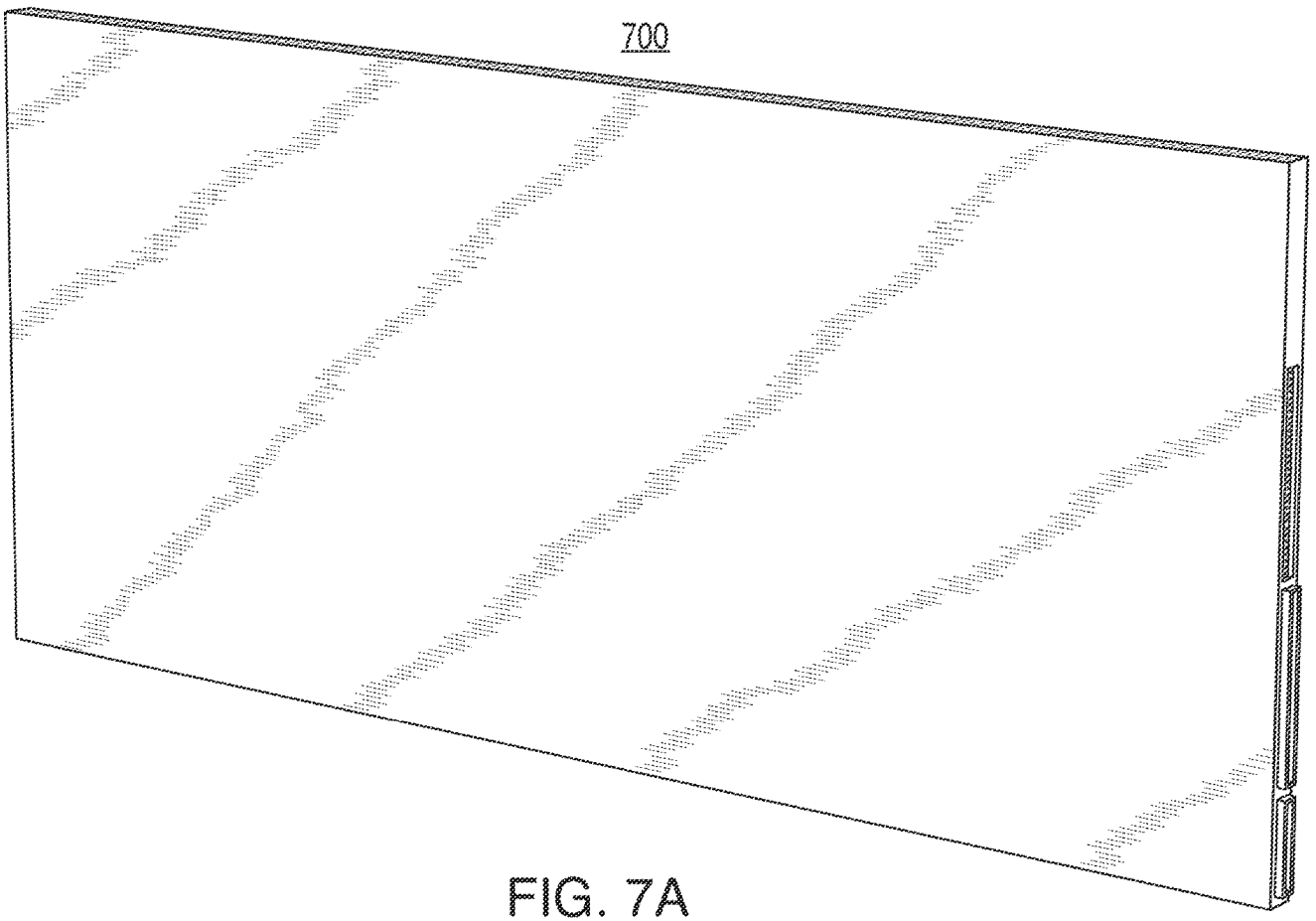
FIGS. 7A-7C show different illustrative views of a partial enclosure containing at least one stack of cards according to various embodiments.
Figure 7B:
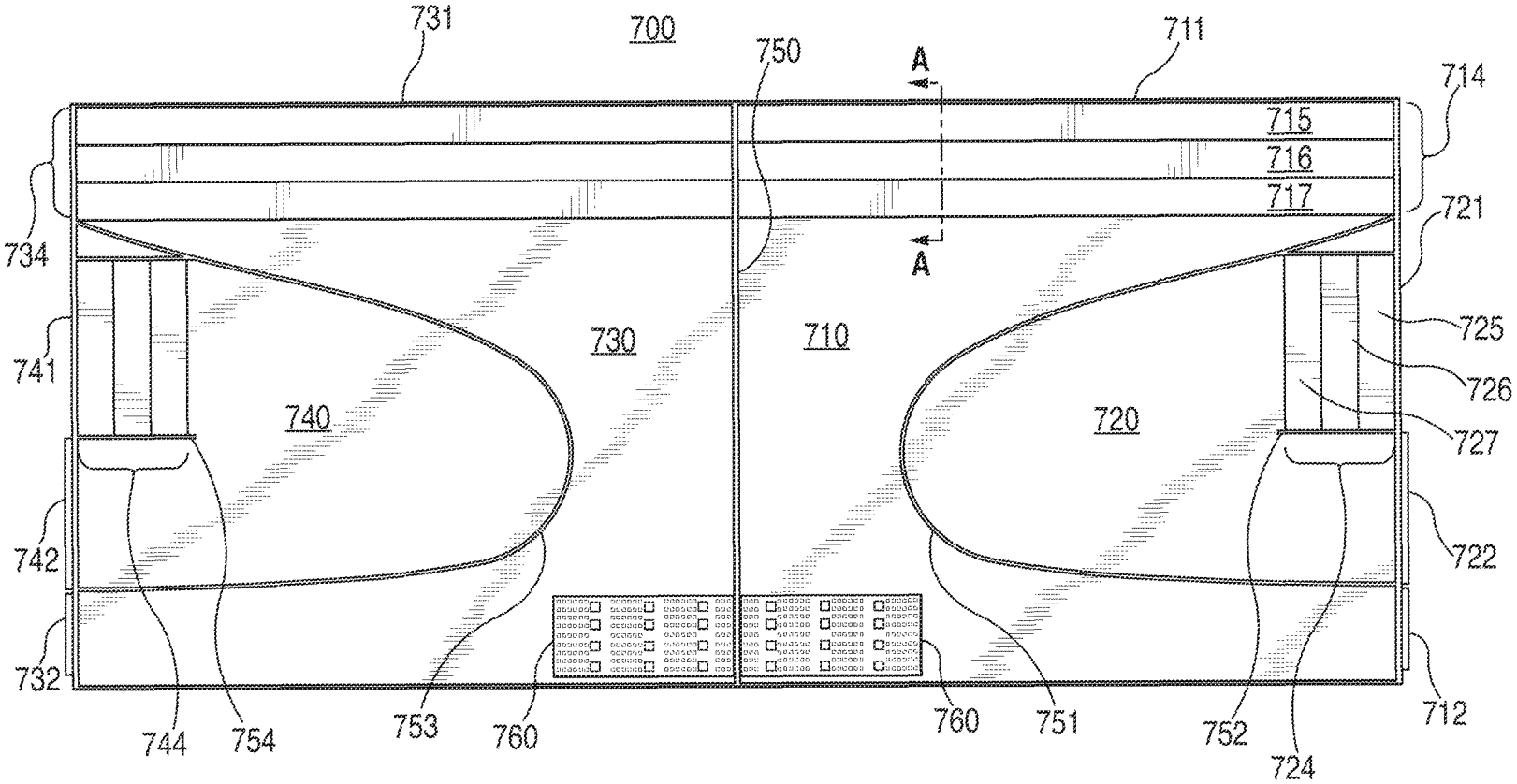
Figure 7C:
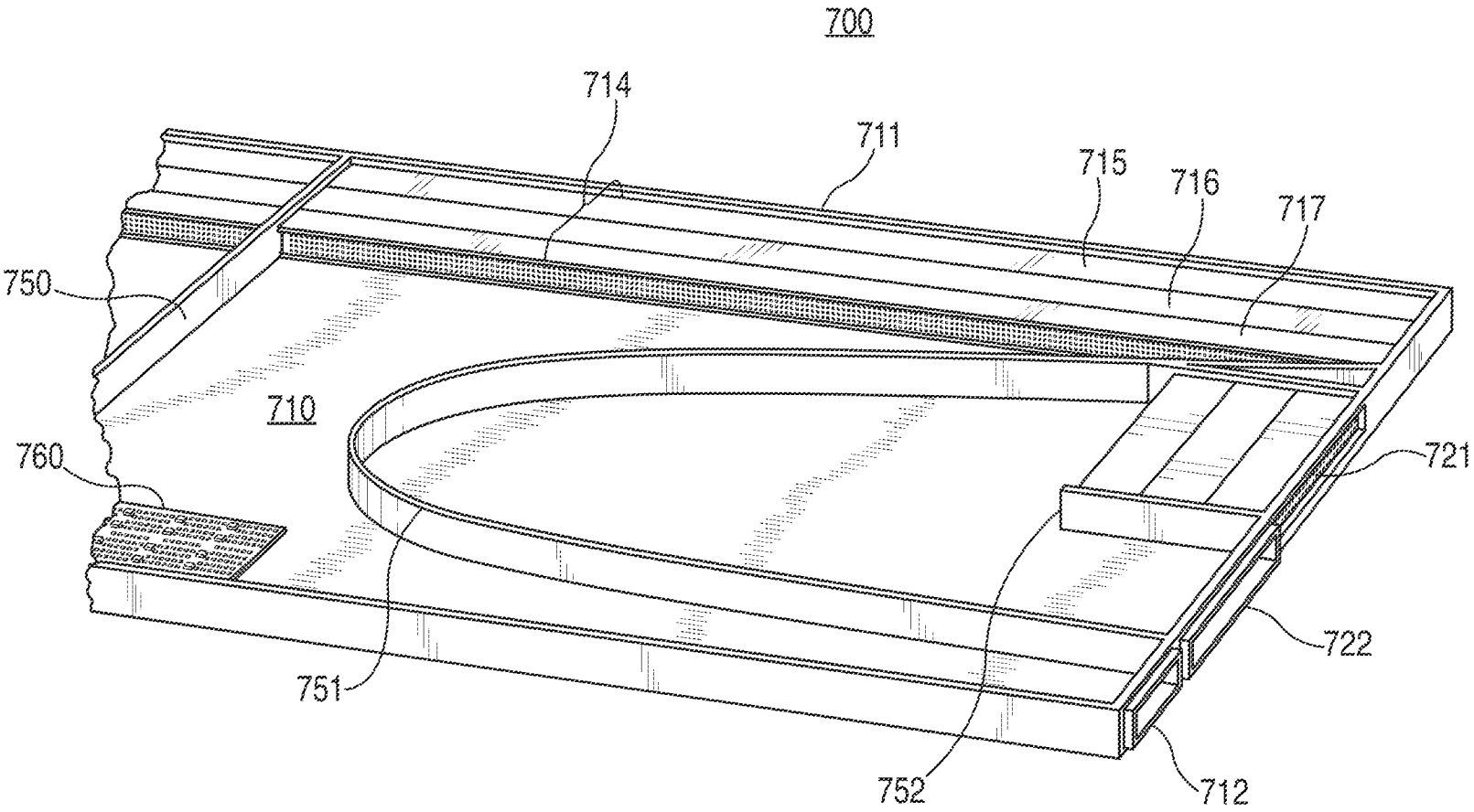

FIGS. 7A-7C show different illustrative views of a partial enclosure containing at least one stack of cards according to various embodiments. FIG. 7A shows an illustrative perspective view, FIG. 7B shows a front view with the cover removed, and FIG. 7C shows a partial perspective view with a cover removed. The following discussion collectively refers to FIGS. 7A-7C and some elements may appear in some figures, but not others. Enclosure 700 can include acoustically isolated regions 710, 720, 730, and 740 that each can include two openings that are exposed to an ambient environment. For example, region 710 has openings 711 and 712, region 720 has openings 721 and 722, region 730 has openings 731 and 732, and region 740 has openings 741 and 742. Each region may be associated with at least one stack of electrostatic actuator cards. As shown in FIGS. 7B and 7C, each region is associated with several stacks of cards that are arranged in series. For example, region 710 is associated with series stack 714, which includes card stacks 715-717, and region 720 is associated with series stack 724, which includes card stacks 725-727. The number of card stacks shown to be arranged in series is merely illustrative and it should be understood that any suitable number of cards stacks may be arranged in series.

Each of card stacks 715-717 and 725-727 can include a stack of cards similar to that discussed above in connection with FIGS. 4-6. In series stack 714, card stack 716 is aligned in series with card stack 715 such that the gaps existing between the vent fingers of the two card stacks are co-aligned at the interface existing between the two card stacks. Card stack 717 is aligned in series with card stack 716 such that the gaps existing between the vent fingers of the two card stacks are co-aligned at the interface existing between the two card stacks. This way, when air is pumped in and out of opening 711, directly coupled card stacks pump air into and out of each other. This is illustrated and discussed in more detail in connection with FIG. 8, discussed below. In series stack 724, card stack 726 is placed adjacent to card stack 725, and card stack 727 is place adjacent to card stack 726. Co-alignment of gaps is provided between adjacently coupled card stacks to enable air to be pumped into and out of adjacent card stacks.

The regions may be defined by channels 750-754 that serve as barriers that prevent air from passing through them. One or more of channels 750-754 may define path lengths for sound waves to travel as they are emitted by one of the series stacks. For example, two different path lengths may exist for series stack 714. A first path may run from a first face of series stack 714 to opening 711. A second path may run from a second face of series stack 714 to opening 712. The first path is shorter relative to the second path. The second path is defined by channels 750 and 751. Channels 750 and 751 may be used to increase the second path length relative to the first path length to prevent the sound waves being emitted out of a second side from cancelling out sound waves being emitted out of the first side. That is, the second path is sized different relative to the first path so that the out-of-phase sound waves being emitted from the second side of the series stack assist, rather than detract, from the in-phase sound waves being emitted from the first side of the series stack. It should be understood that the sound waves emanating from opposite ends of enclosure 700 may not be perfectly in phase for all frequencies; however enclosure 700 substantially reduces the cancellation effect for the average of all frequencies Two different path lengths may also exist for series stack 724. A first path may exist between a first face of series stack 724 and opening 721 and a second path may exist between a second face of series stack 724 and opening 722. The second path is longer than the first path and is defined by channel 751 and 752. It should be appreciated that similar path lengths exist for series stacks 734 and 744.

Electronics 760 may be included within enclosure 700, as shown, or outside of enclosure 700. Electronics 760 may be operative to control operation of each electrostatic actuator card. In particular, electronics 760 may coordinate operation of each card so that each series stack is able to produce desired sound waves.

Arranging card stacks in series increases the pumping pressure to a degree greater than that which can be achieved using just one card stack. Increased pumping pressure enables the series stacks to overcome any backpressure that may exist within enclosure 700 due to the increased acoustic impedance of enclosure 700. As acoustic impedance increases due to the airflow constrictions of an enclosure, the acoustic pressure must also increase to maintain a given peak airflow. Acoustic pressure can be increased by placing card stacks in series and also by increasing the electric field between the stators of the card stacks.

Each card stack has its own internal pressure drop. The pressure the cards are able to generate above/beyond their internal pressure drop can be used to overcome the pressure drop of enclosure 700. Adding card stacks in series does increase the total internal pressure drop of the cards but also increases the net pressure that can overcome the pressure drop of enclosure 700. Adding more card stacks in series can further increase the net pressure the series stack can produce. Adding additional cards is akin to adding batteries (that have their own internal resistance) in series to a circuit, as adding batteries in series will continue to increase the amount of load impedance that can be added to the circuit without dropping the current.

The net pressure produced by placing card stacks in series can be explained as follows. First, imagine card stack 716 is all along and not flanked by card stacks 715 and 717. During operations lone card stack 716 must draw air in at one side at atmospheric pressure and exhaust air out the other side at atmospheric pressure. Second, now imagine card stack 715 is placed adjacent to card stack 716, resulting in a two card series stack. Assume that on one side, card stack 715 draws air in that is above atmospheric pressure, and on its other side, it pushes air out into a partial vacuum. This creates a pressure difference between the inlet and outlet of the card stack 716 that makes it easier for this stack to pump a given volume of air. Third, now imagine that card stack 717 is also placed adjacent to card stack 716, and that the inlet of stack 717 abuts cards stack 716, and the outlet of card stack 717 abut the interior volume of enclosure 700. Pressurized air is provided (due to cards 716 and 715) to the inlet of stack 717, and it is this pressurized air that enables card stack 717 to pump air against the elevated air pressure being applied to its outlet (due to enclosure 700).

In some embodiments, a lone card stack (e.g., stack 717) or a series stack (e.g., series stack 714) can simultaneously produce sound and cool electronics, and in some embodiments, the sound being produced can be inaudible (e.g., 10-20 Hz) such that it effectively only provides cooling. For example, in the context of loudspeaker 700, series stack 714 may cool electronics 760 when it is producing sound. As another example, a series stack being used in a television may be able to cool various components of the televisions. As yet another example, a lone card stack or a series stack may be incorporated into a computing device such as a mobile phone, tablet, or laptop computer to provide sound and/or cooling. Use of a card stack or series stack in this manner is advantageous over conventional cooling fans because there is no need for expensive rare earth magnets nor worry of wearing components out such as ball bearings or bushings.

Figure 8:
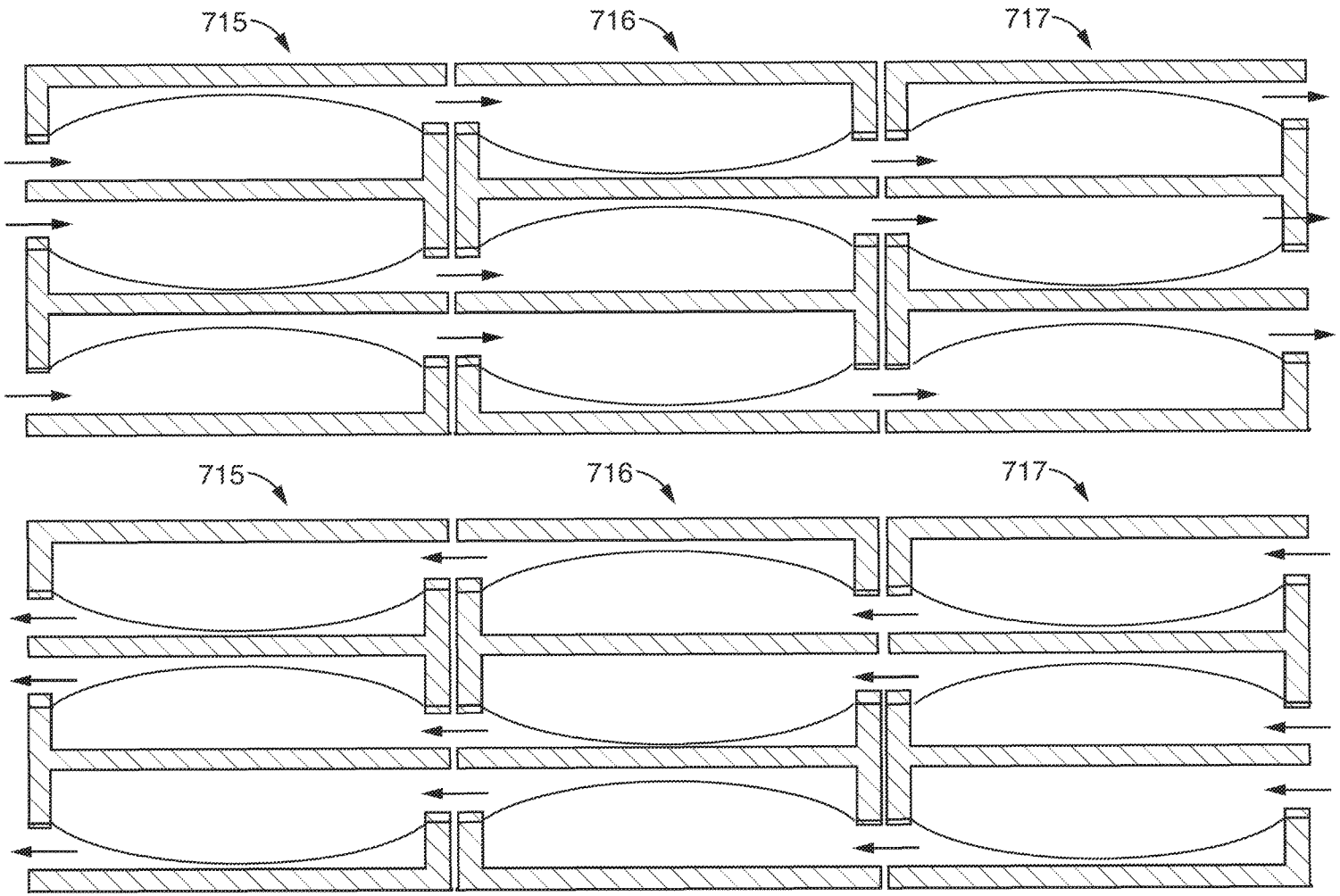
FIGS. 8-10 shows different cross-sectional views of the series stack of FIG. 7, according to various embodiments.
Figure 9:
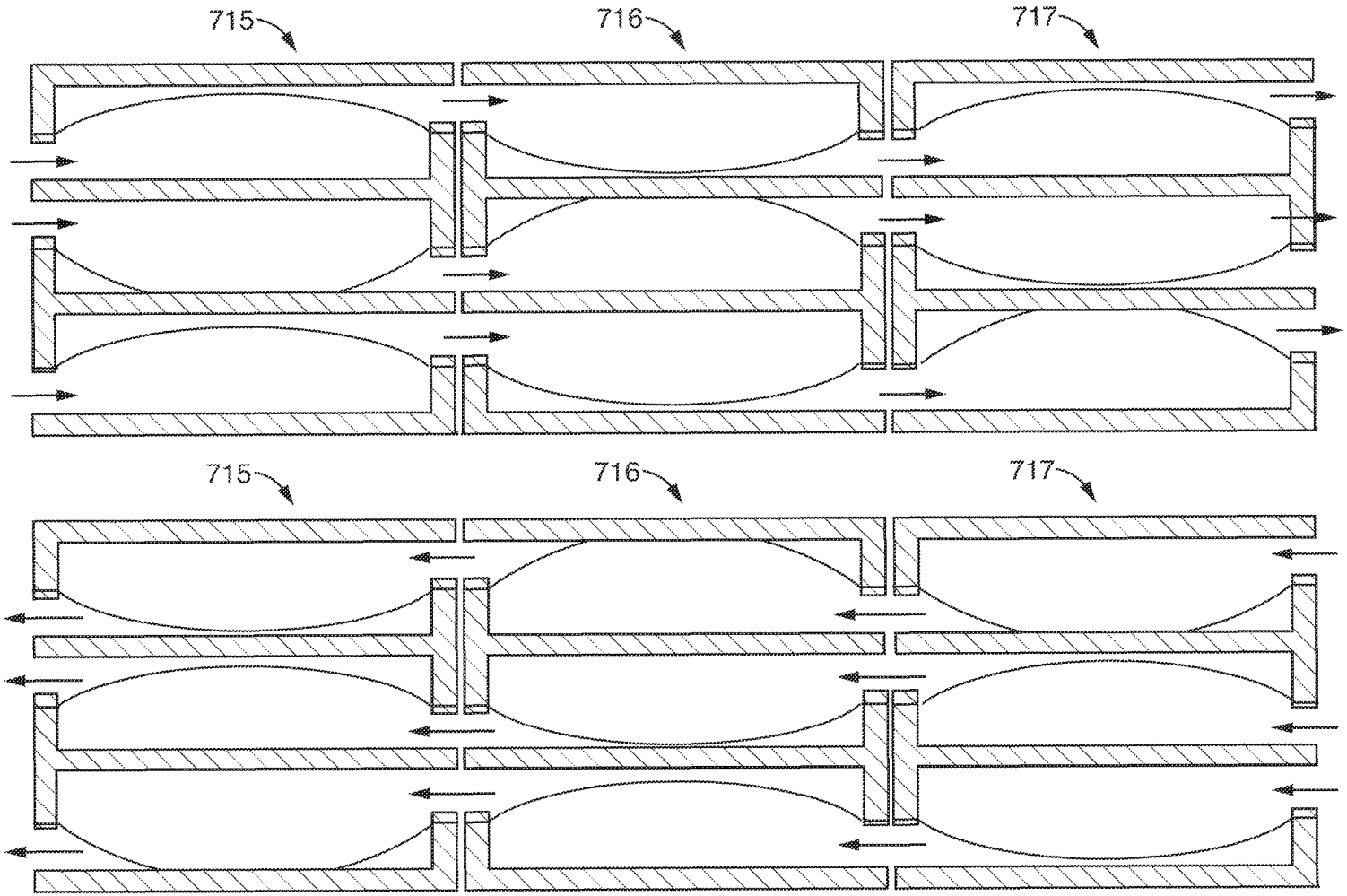
Figure 10:
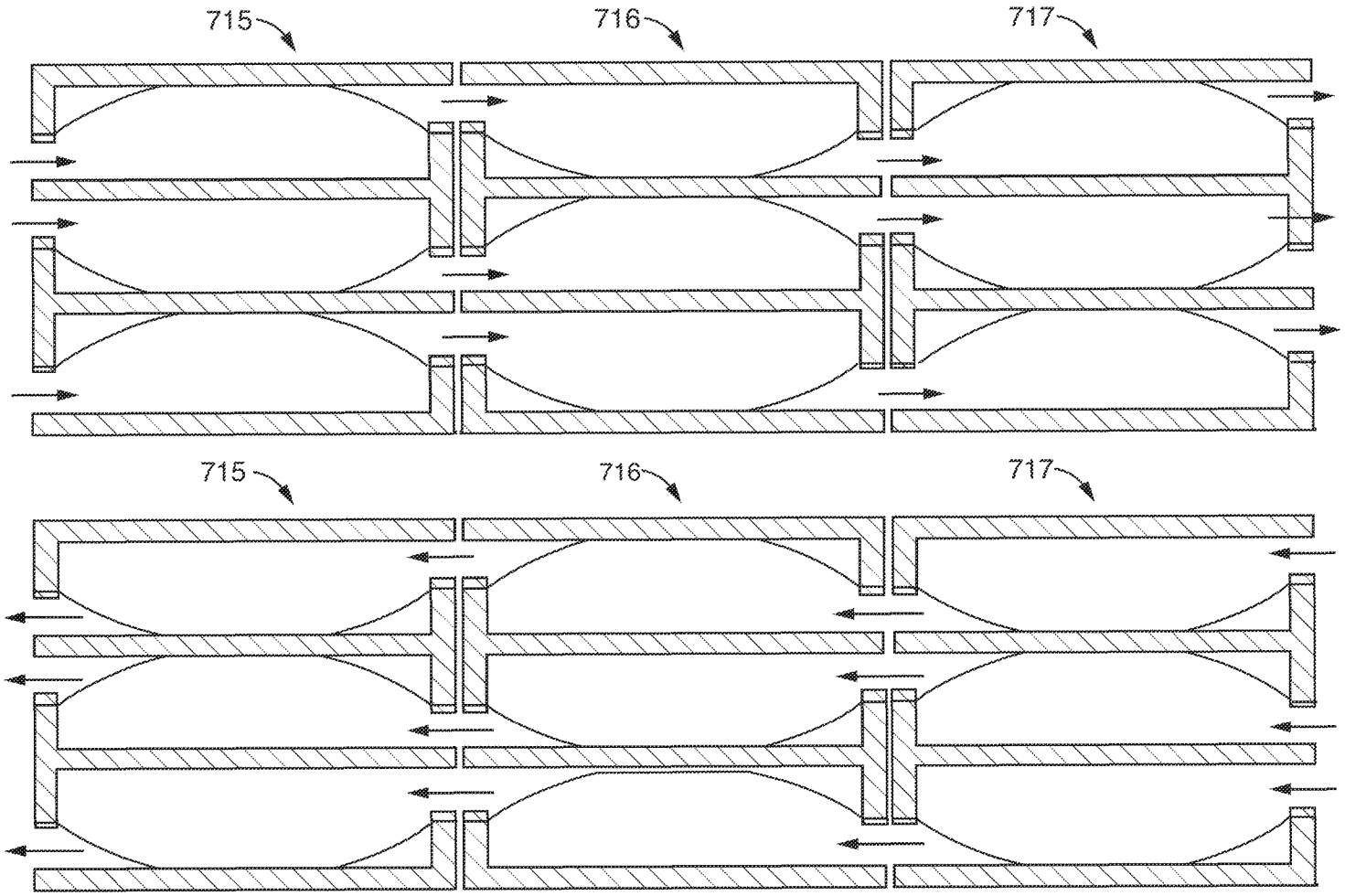

FIGS. 8-10 shows different cross-sectional views of series stack 714 taken along line A-A of FIG. 7B. Each of FIGS. 8-10 show both half-cycles of an audio signal, wherein the first half cycle is shown in the top half of each figure and the second half cycle is shown in the bottom half of each figure. The arrows show the direction of air flow during the first and second half cycles. FIGS. 8-10 are similar is some respects to FIGS. 6A and 6B in that each card stack shows three membranes and four stators. Therefore, similar structures discussed in connection with FIG. 6 are applicable to FIGS. 8-10. FIGS. 8-10 each show card stacks 715-717, where card stack 716 is positioned in series between card stacks 715 and 717. As shown, the vent fingers of card stack 715 are co-aligned with the vent fingers of card stack 716, and the vent fingers of card stack 716 are co-aligned with the vent fingers of card stack 717. A gasket, seal, or adhesive (not shown), may exist at the interface between adjacent card stacks. This gasket, seal, or adhesive may prevent air from escaping the interface existing between adjacent card stacks.

Each of FIGS. 8-10 show the membranes at different locations based, for example, on how hard they are being driven and variations in manufacturing tolerances. In FIG. 8, the membranes may be driven at a nominal power level and are not touching any of the stators. In FIG. 9, the membranes may be driven at a nominal power level, but may be touching the stators. The differences between FIGS. 8 and 9 illustrate how variations in manufacturing tolerances may result in some membranes touching a stator when being pushed or pulled. FIG. 10 illustrates an example where the membranes are driven over the nominal power level to intentionally force the membranes to contact their stators in order to produce higher volumes of sound. As mentioned above, the stators may be laminated with an insulating film, which enables cards to operate even if the membranes come into contact with the stator.

Figure 11:
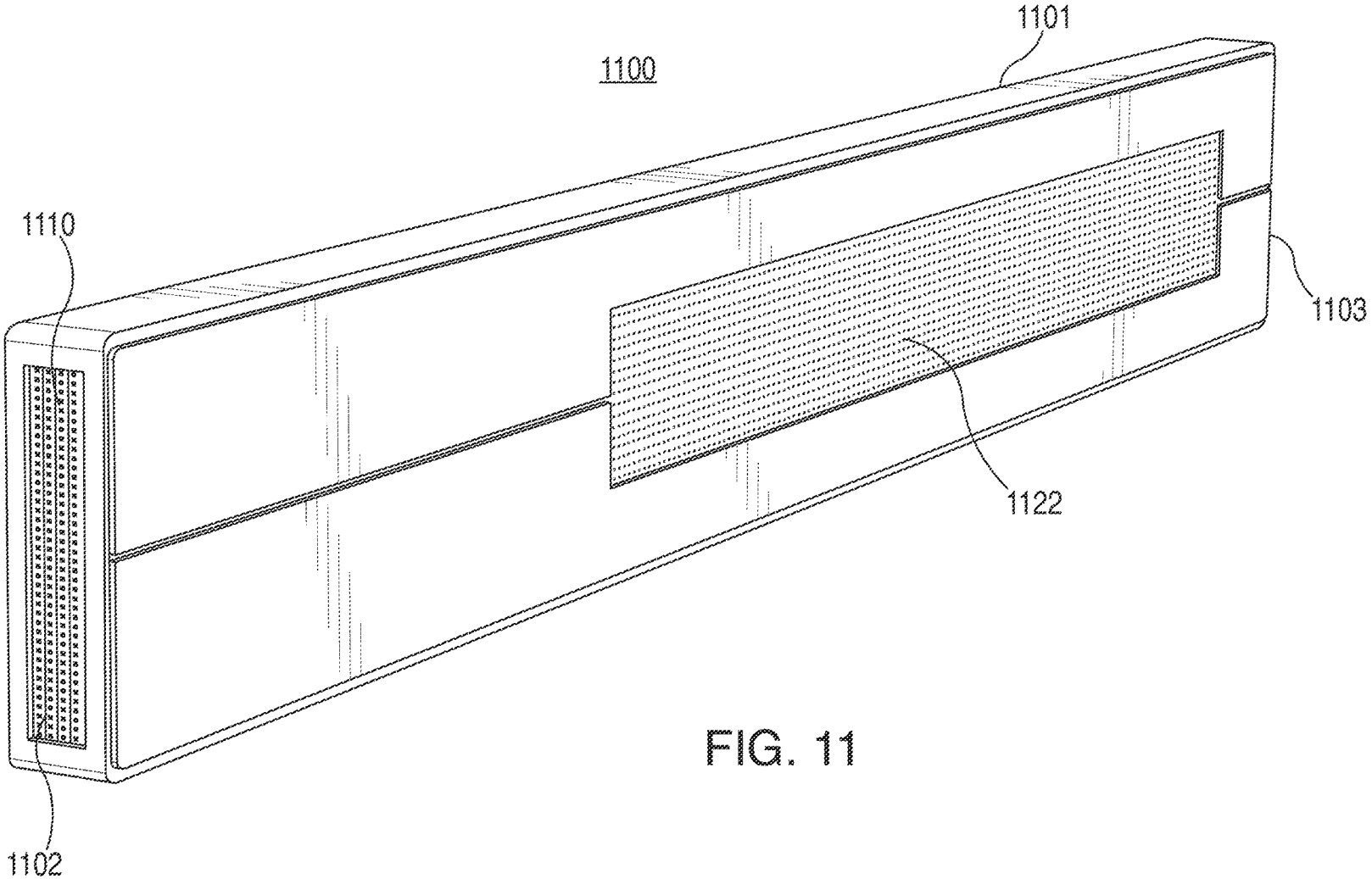
FIGS. 11 and 12 show different views of an illustrative sound bar, according to an embodiment.
Figure 12:
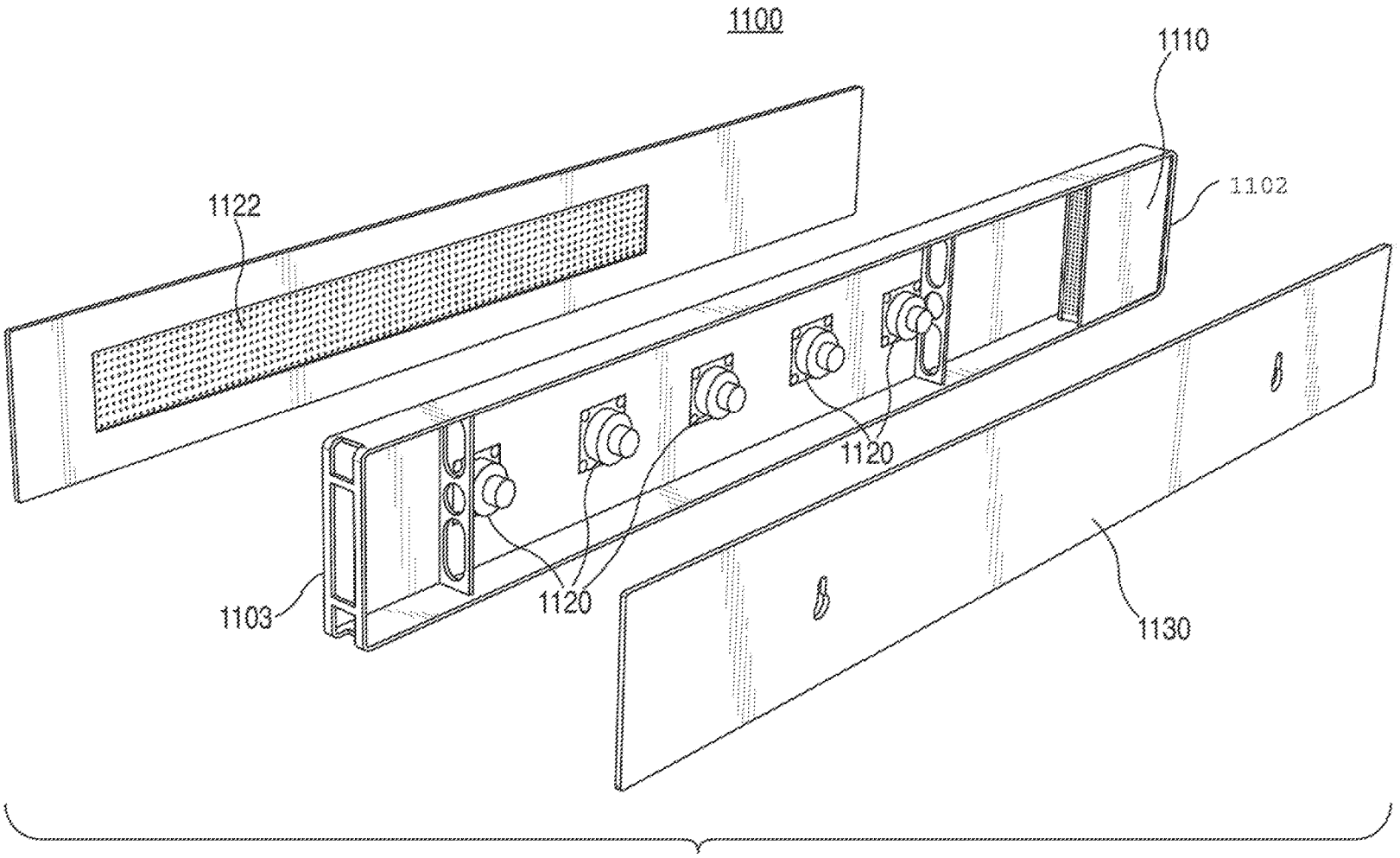

FIGS. 11 and 12 show different views of an illustrative sound bar 1100 according to an embodiment. In particular, FIG. 11 shows an illustrative perspective view of sound bar 1100 and FIG. 12 shows a partial exploded view of sound bar 1100. Sound bar 1100 can include enclosure 1101 that has openings 1102 and 1103. Series stack 1110 may be positioned within enclosure 1101 such that a first face of series stack 1110 is able to pump air in and out of opening 1102. Series stack 1110 may include two or more card stacks arranged in series. A second face of series stack 1110 may pump air in and out of opening 1103. Openings 1102 and 1103 are positioned on opposite ends of enclosure 1101. That is, opening 1102 is positioned on a first side of enclosure 1101 and opening 1103 is positioned on a side that is opposite of the first side. The distance between openings 1102 and 1103 may be sufficient to ensure that the sound exiting both ends of enclosure 1101 are roughly in phase; that is, sound exiting opening 1103 does not substantially cancel out any sound exiting opening 1102.

If desired, conventional speakers 1120 may be included in enclosure 1101 to provide mid and high range frequencies (above about 200 Hz). Speakers 1120 may be positioned to direct sound out of opening 1122. Back plate 1130 may be secure to enclosure 1101 and can serve as an anchor for mounting sound bar 1100.

Figure 13:
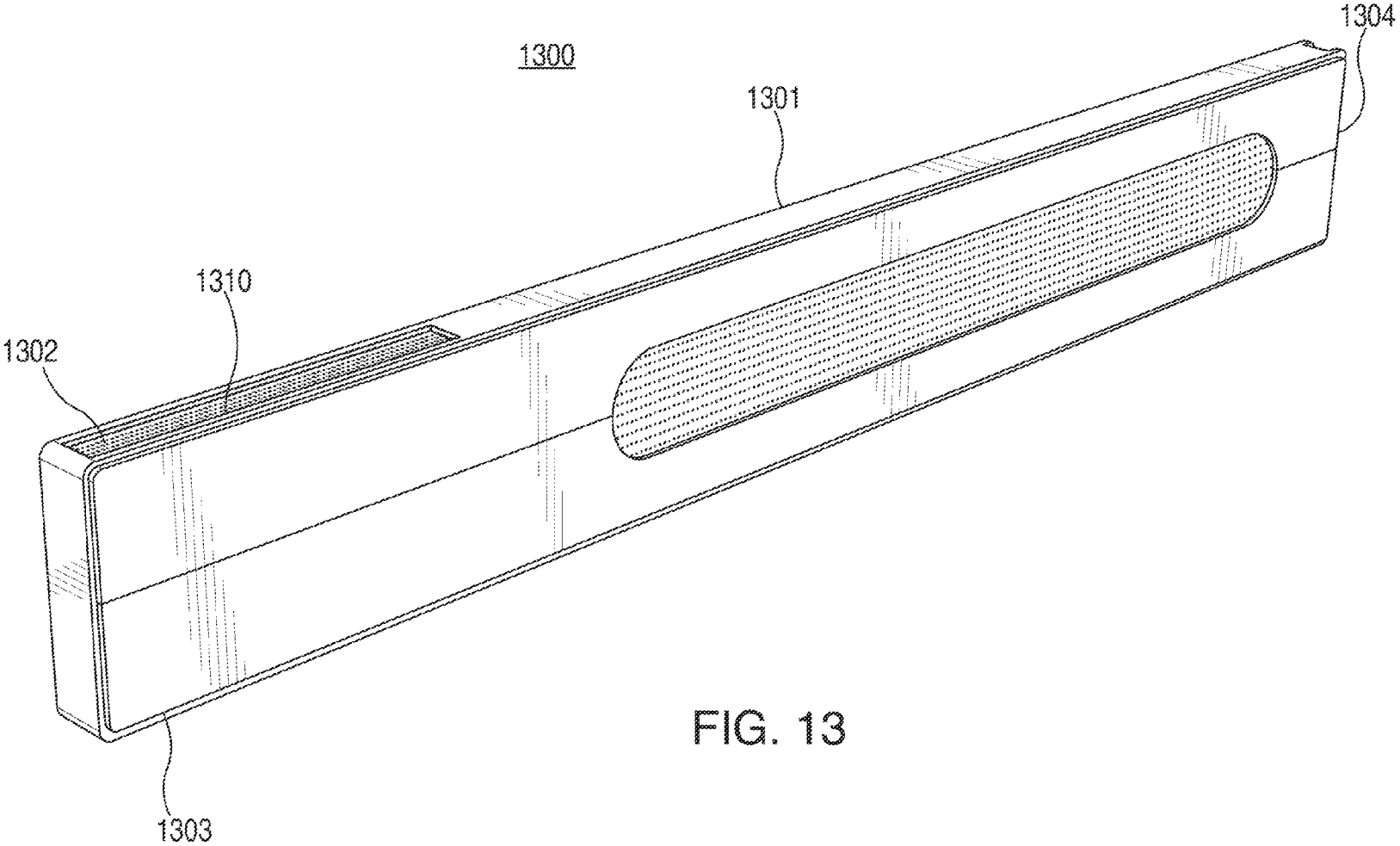
FIGS. 13 and 14 show different views of another illustrative sound bar according to an embodiment.
Figure 14:
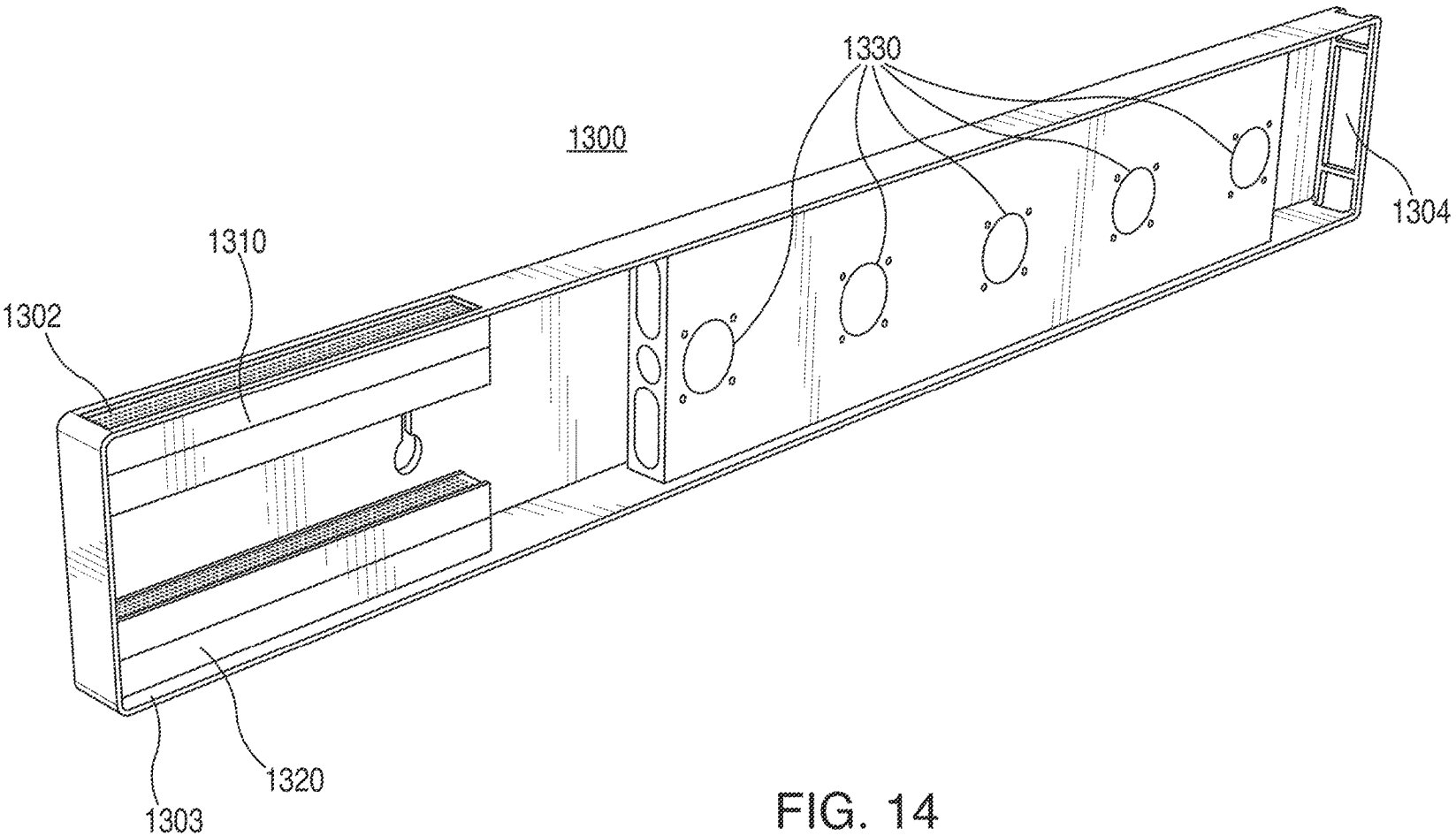

FIGS. 13 and 14 show different views of an illustrative sound bar 1300 according to an embodiment. In particular, FIG. 13 shows an illustrative perspective view of sound bar 1300 and FIG. 14 shows a partial exploded view of sound bar 1300. Sound bar 1300 can include enclosure 1301 that has openings 1302, 1303, and 1304. Series stack 1310 may be positioned within enclosure 1301 such that its first face pumps air in and out of opening 1302 and series stack 1320 may be positioned within enclosure such that its first face pumps air in and out of opening 1303. Opening 1304 may serve as the opening through which the second faces of series stacks 1310 and 1320 can pump air in and out. Compared to sound bar 1100, and assuming the that the series stacks in each sound bar are equal in size, the inclusion of two series stacks in sound bar 1300 may move more air and thus generate more audio power. The distance between opening 1304 to openings 1302 and 1303 may be sufficient to ensure that the sound exiting all openings of enclosure 1301 are roughly in phase. If desired, sound bar can include convention speakers 1330.

Several of the above described embodiments discuss placing two or more card stacks in series in order to sufficiently overcome the back pressure of a partial enclosure. In another embodiment, a single card stack can be used to overcome the back pressure of a partial enclosure by operating it at higher electric fields than conventional electrostatic loudspeakers. For example, doubling the electric field between the stators can double the peak back pressure the membrane can overcome. It has been found that by laminating both sides of a stator with a polyester film (e.g., Mylar) allows for increased electric field strength between the stators to above 3 volts/micrometer (which is the typical limit of conventional electrostatic loudspeakers). By operating at relatively high electric fields loud speakers that use a partial enclosure, a single card stack can be used in lieu of series stacks. For certain particularly restrictive enclosures it may be necessary to use card stacks in series in combination with high electrics fields to maintain a desired peak airflow.

Figure 15:
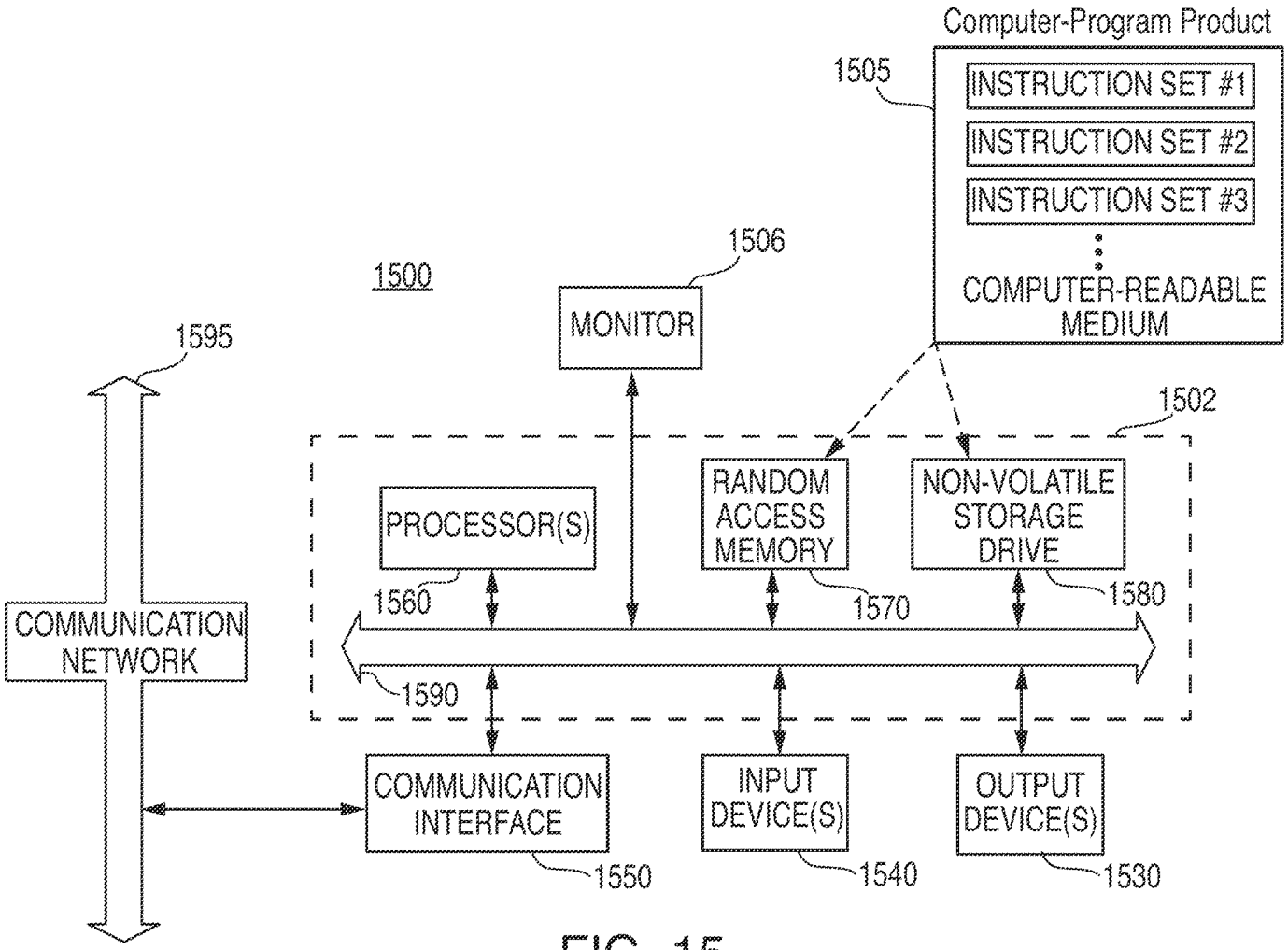
FIG. 15 shows a special-purpose computer system, according to an embodiment.

With reference to FIG. 15, an embodiment of a special-purpose computer system 1500 is shown. For example, one or more intelligent components may be a special-purpose computer system 1500. Such a special-purpose computer system 1500 may be incorporated as part of a loudspeaker and/or any of the other computerized component, such as an electronic circuitry that drives the electrostatic actuator cards. The above methods may be implemented by computer-program products that direct a computer system to perform the actions of the above-described methods and components. Each such computer-program product may comprise sets of instructions (codes) embodied on a computer-readable medium that direct the processor of a computer system to perform corresponding actions. The instructions may be configured to run in sequential order, or in parallel (such as under different processing threads), or in a combination thereof. After loading the computer-program products on a general purpose computer system 1500, it is transformed into the special-purpose computer system 1500.

Special-purpose computer system 1500 can include computer 1502, a monitor 1506 (optional) coupled to computer 1502, one or more additional user output devices 1530 (optional) coupled to computer 1502, one or more user input devices 1540 (e.g., keyboard, mouse, track ball, touch screen) (optional) coupled to computer 1502, an optional communications interface 1550 coupled to computer 1502, a computer-program product 1505 stored in a tangible computer-readable memory in computer 1502. Computer-program product 15805 directs computer system 1500 to perform the above-described operations and/or methods. Computer 1502 may include one or more processors 1560 that communicate with a number of peripheral devices via a bus subsystem 1590. These peripheral devices may include user output device(s) 1530, user input device(s) 1540, communications interface 1550, and a storage subsystem, such as random access memory (RAM) 1570 and non-volatile storage drive 1580 (e.g., disk drive, optical drive, solid state drive), which are forms of tangible computer-readable memory.

Computer-program product 1505 may be stored in non-volatile storage drive 1580 or another computer-readable medium accessible to computer 1502 and loaded into random access memory (RAM) 1570. Each processor 1560 may comprise a microprocessor, such as a microprocessor from Intel® or Advanced Micro Devices, Inc.®, or the like. To support computer-program product 1505, the computer 1502 runs an operating system that handles the communications of computer-program product 1505 with the above-noted components, as well as the communications between the above-noted components in support of the computer-program product 1505. Exemplary operating systems include Windows® or the like from Microsoft Corporation, Solaris® from Sun Microsystems, LINUX, UNIX, and the like.

User input devices 1540 include all possible types of devices and mechanisms to input information to computer 1502. These may include a keyboard, a keypad, a mouse, a scanner, a digital drawing pad, a touch screen incorporated into the display, audio input devices such as voice recognition systems, microphones, and other types of input devices. In various embodiments, user input devices 1540 are typically embodied as a computer mouse, a trackball, a track pad, a joystick, wireless remote, a drawing tablet, a voice command system. User input devices 1540 typically allow a user to select objects, icons, text and the like that appear on the monitor 1506 via a command such as a click of a button or the like. User output devices 1530 include all possible types of devices and mechanisms to output information from computer 1502.

Communications interface 1550 provides an interface to other communication networks, such as communication network 1595, and devices and may serve as an interface to receive data from and transmit data to other systems, WANs and/or the Internet. Embodiments of communications interface 1550 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 1550 may be coupled to a computer network, to a FireWire® bus, or the like. In other embodiments, communications interface 1550 may be physically integrated on the motherboard of computer 1502, and/or may be a software program, or the like.

RAM 1570 and non-volatile storage drive 1580 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 1570 and non-volatile storage drive 1580 may be configured to store the basic programming and data constructs that provide the functionality of various embodiments of the present invention, as described above.

Software instruction sets that provide the functionality of the present invention may be stored in RAM 15870 and non-volatile storage drive 1580. These instruction sets or code may be executed by the processor(s) 1560. RAM 1570 and non-volatile storage drive 1580 may also provide a repository to store data and data structures used in accordance with the present invention. RAM 1570 and non-volatile storage drive 1580 may include a number of memories including a main random access memory (RAM) to store instructions and data during program execution and a read-only memory (ROM) in which fixed instructions are stored. RAM 1570 and non-volatile storage drive 1580 may include a file storage subsystem providing persistent (non-volatile) storage of program and/or data files. RAM 1570 and non-volatile storage drive 1580 may also include removable storage systems, such as removable flash memory.

Bus subsystem 1590 provides a mechanism to allow the various components and subsystems of computer 1502 to communicate with each other as intended. Although bus subsystem 1590 is shown schematically as a single bus, alternative embodiments of the bus subsystem may utilize multiple busses or communication paths within the computer 1502.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known, processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Any processes described with respect to FIGS. 1-15, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions that can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A loudspeaker comprising:

a partial enclosure comprising at least two openings exposed to an ambient environment;

a series stack of electrostatic actuator cards secured within the partial enclosure, the series stack operative to direct sound waves out at least one of the two openings, wherein the series stack comprises a plurality of stacks of electrostatic actuator cards, wherein the electrostatic actuator cards of each stack are mounted on top of each other, and wherein the stacks are arranged in series such that one stack of cards is placed immediately adjacent to another stack of cards, and wherein each electrostatic actuator card comprises:

a stator; an electrically conductive membrane; a non-conductive member comprising a plurality of vent fingers that are secured to the stator and the electrically conductive membrane, wherein a plurality of air gaps exist in between the plurality of vent fingers along a first face of the electrostatic card; and control circuitry coupled to the series stack and operative to drive the electrostatic actuator cards to generate sound waves in response to an acoustic signal.

2. The loudspeaker of claim 1, wherein each stack of electrostatic actuator cards comprises at least 20 electrostatic actuator cards per inch.

3. The loudspeaker of claim 1, wherein a first stack in the series stack is exposed to a first one of the openings and wherein a last stack in the series stack is exposed to a second one of the openings, and wherein vents existing within the first and last stack enable sound waves to pass from the series stack to one of the first and second openings.

4. The loudspeaker of claim 3, further comprising at least one intermediate stack that exists between the first and last stack, and wherein each intermediate stack comprises vents that co-align with vents of at least one of the first, last, and intermediate stack.

5. The loudspeaker of claim 4, wherein a greater number of intermediate cards results in increased sound pressure generation by the series stack.

6. A loudspeaker comprising:

a partial enclosure comprising at least two openings exposed to an ambient environment;

a series stack of electrostatic actuator cards secured within the partial enclosure, the series stack operative to direct sound waves out at least one of the two openings; and control circuitry coupled to the series stack and operative to drive the electrostatic actuator cards to generate sound waves in response to an acoustic signal, wherein each stack of electrostatic actuator cards comprises:

first and second stators;

an electrically conductive membrane positioned between the first and second stators;

first plurality of air gaps aligned along a first face of the membrane and that exist between a first plurality of non-conductive members secured between the first stator and the electrically conductive membrane; and second plurality of air gaps aligned along a second face of the membrane and that exist between a second plurality of non-conductive members secured between the second stator and the electrically conductive membrane, wherein the first and second faces are opposite of each other.

7. The loudspeaker of claim 6, wherein control circuitry is operative to induce an electric field between the first and second stators to electrostatically actuate the electrically conductive membrane in a push/pull cycle to pump air through the first and second plurality of air gaps.

8. The loudspeaker of claim 7, wherein the electrically conductive membrane is overdriven such that it physically contacts one of the stators during the push/pull cycle.

9. The speaker of claim 6, wherein the electrically conductive membrane comprises a polyester film having a vapor deposited metal disposed thereon.

10. The speaker of claim 6, wherein the first and second stators are laminated with an insulating film layer.

11. The speaker of claim 6, wherein the electrically conductive membrane is a first membrane, wherein each stack of electrostatic actuator cards further comprises:

a third stator; and a second electrically conductive membrane positioned between the second and third stators, where the second stator is a shared stator for the first and second electrically conductive membranes.

12. The loudspeaker of claim 6, wherein each stack of electrostatic actuator cards comprises:

a first membrane frame member coupled to the first plurality of non-conductive members and the electrically conductive membrane, wherein the first plurality of air gaps are associated with the first plurality of non-conductive members; and;

a second membrane frame member coupled to the second plurality of non-conductive members and to the electrically conductive membrane, wherein the second plurality of air gaps are associated with the second plurality of non-conductive members.

* * * * *